US005294760A

United States Patent [19]

Bower et al.

[11] Patent Number: 5,294,760

[45] Date of Patent: Mar. 15, 1994

[54] DIGITAL PRESSURE SWITCH AND METHOD OF FABRICATION

[75] Inventors: Robert W. Bower, Davis; Mohd S. Ismail, West Sacramento, both of Calif.

[73] Assignee: The Regents of the University of California, Oakland, Calif.

[21] Appl. No.: 903,830

[22] Filed: Jun. 23, 1992

[51] Int. Cl.[5] ..... H01H 35/40

[52] U.S. Cl. ..... 200/83 N; 200/83 B

[58] Field of Search ..... 200/5 A, 5 R, 83 R, 200/83 A, 83 B, 83 N, 83 Z

[56] References Cited

U.S. PATENT DOCUMENTS

| | | | |
|---|---|---|---|
| 4,543,457 | 9/1985 | Peterson et al. | 200/83 N |
| 5,164,558 | 11/1992 | Huff et al. | 200/83 |
| 5,177,579 | 1/1993 | Jerman | 73/724 |

OTHER PUBLICATIONS

K. Peterson; "Silicon As A Mechanical Material"; May 1982; Proceedings of the IEEE vol. 70, No. 5.

S. Timoshenko, S. Woinowksy-Krieger; "Bending of Long Rectangular Plates To A Cylindrical Surface"; 1959; Theory of Plates and Shells; (New York: McGraw-Hill).

R. W. Bower, M. S. Ismail, S. N. Farrens, "Aligned Wafer Bonding: A Key to Three Dimensional Microstructures"; May 1991; Journal of Electronic Materials vol. 20, No. 5.

S. Terry, H. Allen, D. deBruin, J. Knutti; "A Monolithic Silicon Switch System for Tire Pressure Measurement"; 1987; Transducers 1987.

M. Huff, A. Nikolich, M. Schmidt; "Threshold Pressure Switch Utilizing Plastic Deformation of Silicon"; Jun. 24, 1991; International Conference on Solid State Sensor's and Actuators, San Francisco, Calif.

*Primary Examiner*—Jeffrey A. Gaffin
*Assistant Examiner*—Michael A. Friedhofer
*Attorney, Agent, or Firm*—John B. O'Banion

[57] ABSTRACT

A micromachined pressure switch and method of fabrication from silicon wafers using aligned fusion bonding. Pattern etched thermally grown silicon dioxide insulating pads are used to determine the size of silicon pressure membranes on an upper silicon wafer, with the desired switch gap set the by the oxide thickness. The silicon membranes are formed by controlled thinning the upper silicon wafers. V-shaped vent grooves are pattern etched into a bottom silicon wafer to form electrodes to which the insulating pads are fusion bonded. The area between the electrodes and the membrane forms wells of specified sizes into which the membranes deflect upon application of pressure. The pressure switch operates when the membrane is deflected to contact the electrodes in the bottom wafer, and closes at the desired pressure threshold for both directions of pressure change with negligible hysteresis. The method of fabrication apples to a single element pressure switch as well as to an array of pressure switches.

18 Claims, 4 Drawing Sheets

DIGITAL PRESSURE SWITCH AND METHOD OF FABRICATION

BACKGROUND OF THE INVENTION

1. Field of the Invention

This invention pertains generally to pressure switches, and more particularly to fabrication of a micromechanical digital pressure switch array from align fusion bonded silicon wafers.

2. Description of the Background Art

Mechanical pressure switches and their fabrication are well known in the art. Such devices typically provide an output signal in the form of a switch closure or the like in response to application of mechanical or atmospheric pressure. Current fabrication techniques for conventional pressure switches, however, result in pressure switches which are bulky and which do not provide accurate digital output for multiple pressure thresholds.

Several types of micromachined pressure switches can also be found. For example, Terry et al., *A Monolithic Silicon Switch System for Tire Pressure Measurement*, published in Transducers '87 Technical Digest p. 76 (1987) discloses a silicon micromachined pressure switch with electrostatic hysteresis for tire pressure monitoring. Huff et al., *A Threshold Pressure Switch Utilizing Plastic Deformation of Silicon*, published in Transducers '91 Technical Digest p. 181 (1991) discloses a threshold pressure switch utilizing plastic deformation of a silicon membrane using wafer bonding technology.

The foregoing information reflects the state of the art of which the applicant is aware and is tendered with the view toward discharging applicant's acknowledged duty of candor in disclosing information which may be pertinent in the examination of this application. It is respectfully stipulated, however, that none of these disclosures teach or render obvious, singly or when considered in combination, applicant's claimed invention.

SUMMARY OF THE INVENTION

The present invention pertains generally to a pressure switch array which operates on the principal of closing electrical contacts by deflecting resilient membranes in an upper wafer to a point of contact with the bottom wafer. In a typical embodiment, the corresponding pressure threshold levels are ¼, ½, ¾, and 1 atm. The switches in the array operate without any significant hysteresis characteristic which may be advantageous in many applications.

An individual pressure switch in the present invention generally comprises an upper silicon membrane as a dynamic electrode separated from a lower substrate silicon wafer (as a rigid electrode) by a silicon dioxide layer of defined thickness. An array of pressure switches generally comprises different geometries of isolated silicon membranes. The state of an individual switch element, j, in the array is a binary function determined by whether the pressure difference across the membrane is greater or less than a given pressure, Pj. The geometry of each element of the array is designed to change states at a desired pressure difference. By electrically isolating each of the membranes, the logic states of this array of cells defines a binary function describing the pressure difference of the system. In each of the cells, the membrane deflects and makes an electrical contact with the lower wafer, which is a common electrode, when a desired pressure difference has been reached. Thus, each element of the array behaves as a micromechanical switch which activates at a given pressure.

An object of the invention is to provide a pressure switch with digital outputs corresponding to selected pressure thresholds.

Another object of the invention is to provide for fabrication of a digital pressure switch from fusion bonded silicon wafers.

Another object of the invention is to provide an integrated silicon based pressure switch without hysteresis.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
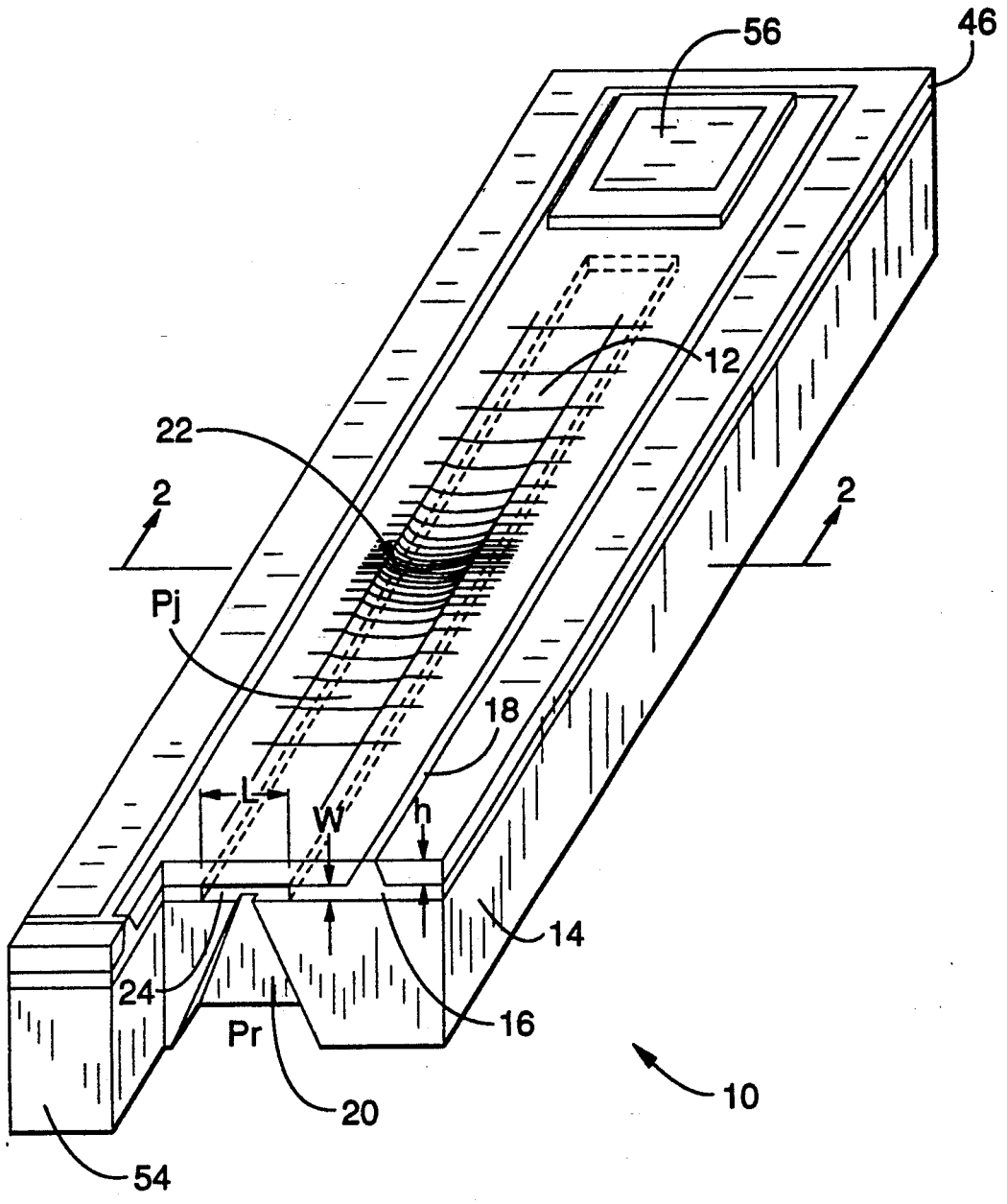
FIG. 1 is a diagrammatic view of the pressure switch of the present invention.
Figure 2:
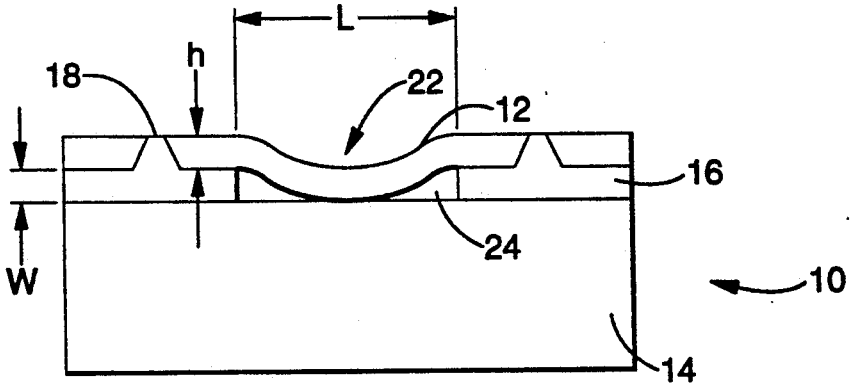
FIG. 2 is a cross-section view of the pressure switch of FIG. 1 taken through line 2—2 and shows the pressure membrane in a deflected position.
Figure 8:
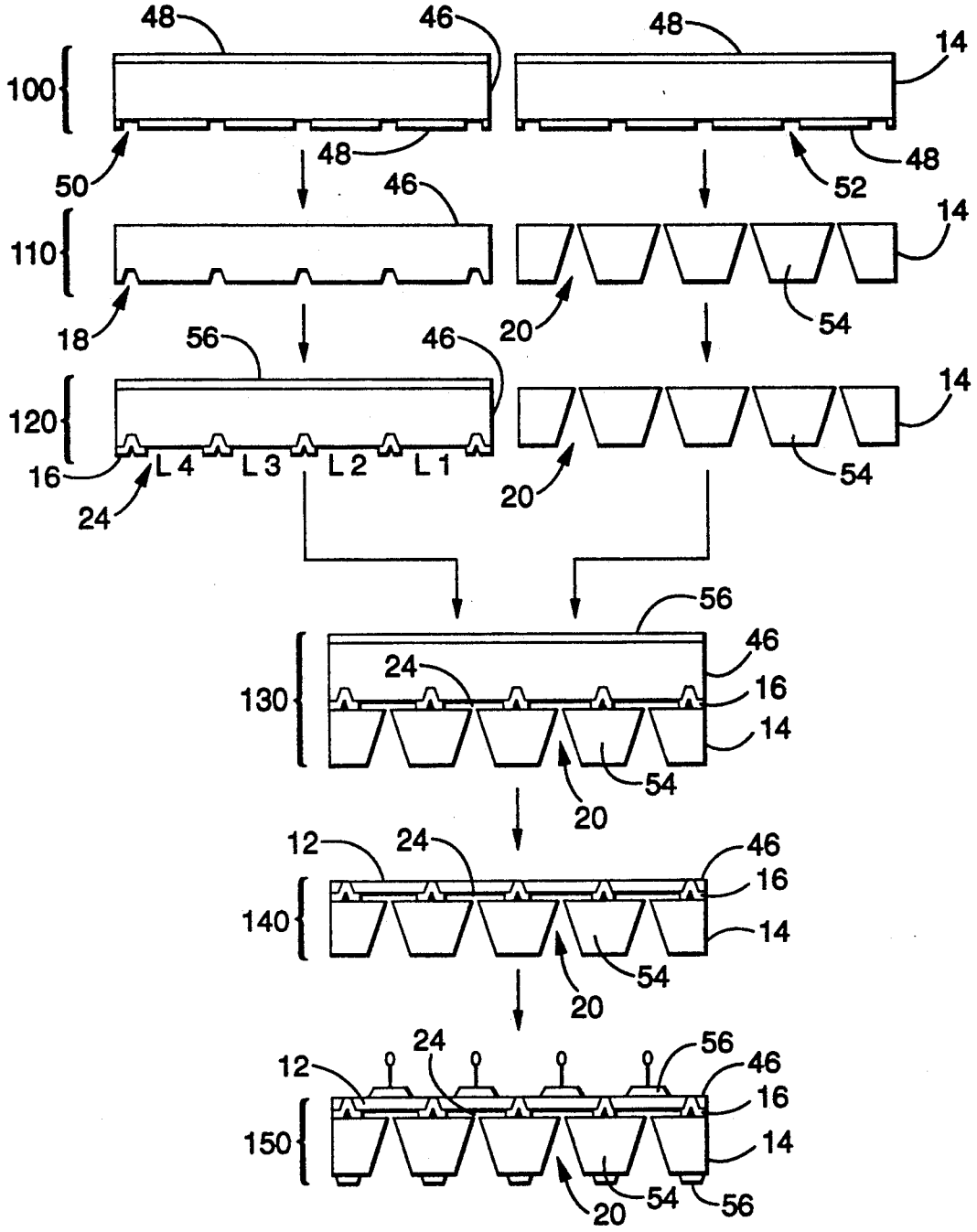
FIG. 8 diagrammatically shows a process flow diagram for the fabrication of an array of pressure switches of the present invention viewed as a cross-section.

Referring more specifically to the drawings, for illustrative purposes the present invention is embodied in the apparatus generally shown in FIG. 1 and FIG. 2, and in the method steps generally shown in FIG. 8. It will be appreciated that the apparatus may vary as to configuration and as to details of the parts without departing from the basic concepts as disclosed herein. It will also be appreciated that the method of the present invention may vary as to the steps and their sequence without departing from the basic concepts disclosed herein.

Referring to FIG. 1 and FIG. 2 together, an exemplary pressure switch 10 includes an upper silicon pressure membrane 12 (shown in a deflected position in FIG. 2) as a dynamic electrode separated from a lower substrate silicon wafer 14 (as a rigid electrode) by an insulating thermal oxide layer of defined thickness which is patterned to form an isolation pad 16. Typically this thermal oxide layer is formed from silicon dioxide. Isolation pad 16 also separates membrane 12 from adjacent membranes in an array of pressure switches by filling isolation grooves 18 etched between the membranes. Vent 20 permits displacement of any gasses between membrane 12 and lower substrate silicon wafer 14 when membrane 12 is deflected. The area of maximum deflection 22 is located at approximately the midpoint of membrane 12 in the embodiment shown, and operation of the switch occurs when membrane 12 is deflected into well 24 thereby making contact with electrode 54. Electrode 54 is typically the entire wafer 14, but can alternatively be a defined region of wafer 14.

An array of pressure switches 10 comprises a plurality of isolated membranes 12 having different geometries. The state of a pressure switch element, j, of an array is a binary function determined by whether the pressure difference across the membrane is greater or less than a given pressure, Pj. Therefore, the geometry of each element of the array is designed to change states at a desired pressure difference. By electrically isolating each of the membranes, the logic states of this array of switches defines a binary function describing the pressure difference of the system. In each of the switches, the membrane deflects and makes an electrical contact with the lower wafer, which is a common electrode, when a desired pressure difference has been reached. Thus, each element of the array behaves as a micromechanical switch which activates at a given pressure.

Figure 3:
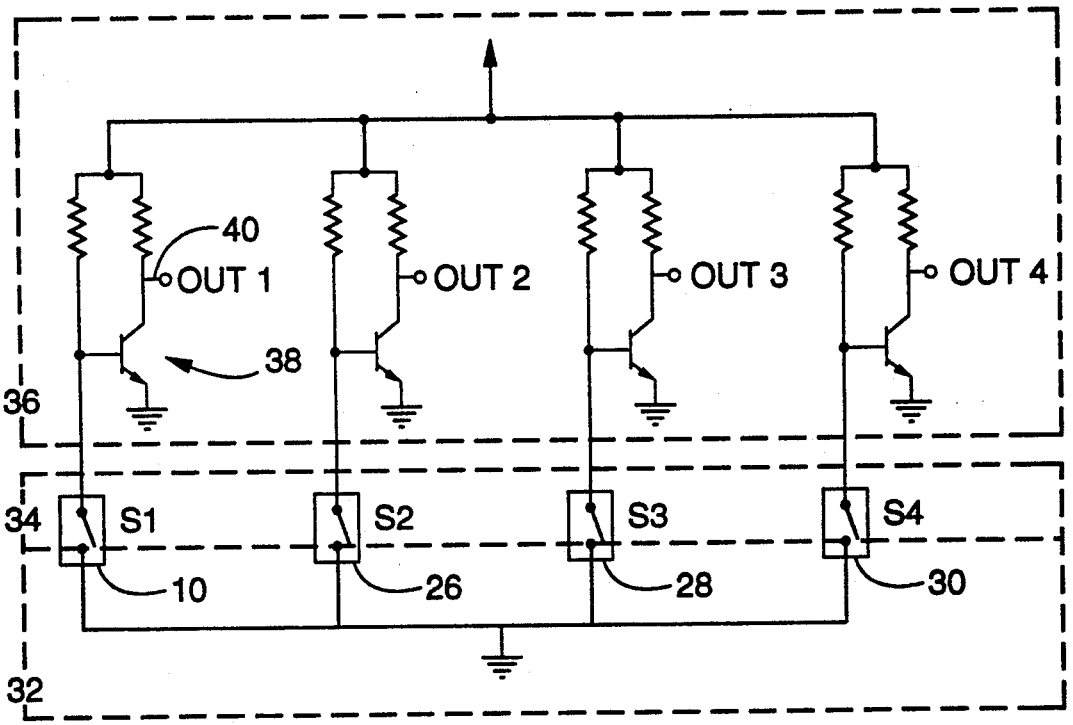
FIG. 3 is schematic diagram of electrical connections of an array of pressure switches of the present invention coupled to an array of output drivers.

Referring now to FIG. 3, the digital outputs of an array of weighted pressure switches 10, 26, 28 and 30 fabricated from a lower wafer 32 and an upper wafer 34 can be seen schematically. As shown, the pressure switches are coupled to an array of solid state drivers 36. Using one pressure switch as an example, when pressure switch 10 is open, transistor 38 is driven into saturation which forces the output terminal 40 to be a digital logic "0." At a predetermined pressure difference, pressure switch 10 closes, thereby introducing a low base voltage to transistor 38 which then operates in the cut-off region resulting in the corresponding output being at a digital logic '1'.

A pressure level is an essential device employed in digital pressure sensor array systems. Considering an array of four pressure switches S1, S2, S3, S4 with corresponding pressure levels P1, P2, P3, P4 where P1<P2<P3<P4, then the state of this digital pressure switch array is represented in Table 1:

TABLE 1

| Pressure P | S1 | S2 | S3 | S4 | Out 1 | Out 2 | Out 3 | Out 4 |
|---|---|---|---|---|---|---|---|---|
| P < 1 | open | open | open | open | 0 | 0 | 0 | 0 |
| P ≦ P < P2 | closed | open | open | open | 1 | 0 | 0 | 0 |
| P2 ≦ P < P3 | closed | closed | open | open | 1 | 1 | 0 | 0 |
| P3 ≦ P < P4 | closed | closed | closed | open | 1 | 1 | 1 | 0 |
| P4 ≦ P | closed | closed | closed | closed | 1 | 1 | 1 | 1 |

The sensitivity of the array depends upon the size of pressure range sensed and the number of switch points. As the number of pressure switches in the array increases, the sensitivity of the system improves. Direct interface to a digital electronics array may be used to reduce undesirable switch noise caused by small fluctuations in the pressure level being sensed, or switch bounce.

Figure 5:
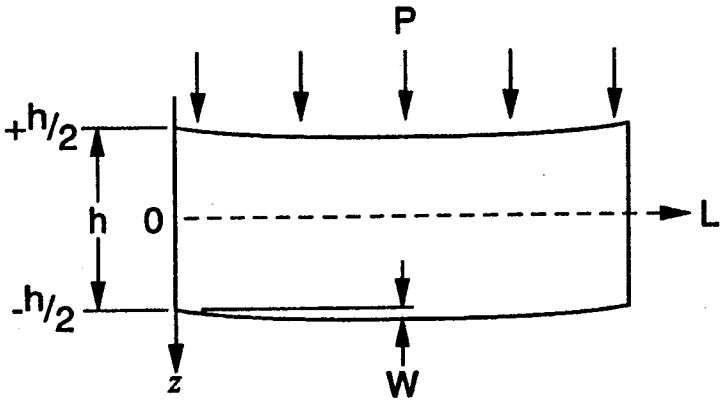
FIG. 5 is a diagrammatic cross-section view of the pressure membrane of FIG. 4 taken through line 5—5.
Figure 4:
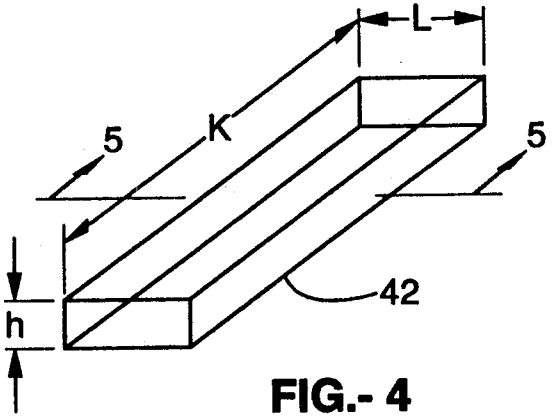
FIG. 4 is a diagrammatic view of the pressure membrane of the pressure switch of the present invention represented as an elongated rectangular plate.

Referring now to FIG. 4, membrane 12 which serves as the upper electrode of pressure switch 10 can be represented as a long rectangular plate 42. One of the dimensions K (length) is chosen to be at least ten times larger than one of the other dimensions L (width); let K>10L with a uniform membrane thickness of h<L. The bending of plate 42 can then be analyzed as an elemental beam with length L which is subjected to a uniform applied pressure P. Referring also to FIG. 5, the maximum deflection W of an elemental strip cut from plate 42 can be summarized by the following equations for the device dimensional parameters as are shown in FIG. 1 and FIG. 2.

The maximum deflection is W=w(x=L/2) and given by, $$W=(PL^4/384D)f(u) \tag{1}$$

where $$D=(Eh^3/12(1-\nu^2)). \tag{2}$$

L is the membrane width, P=Pj−Pr is the pressure difference, E is the Young's modulus of the silicon, h is the membrane thickness, v is Poisson's ratio and f(u) is expressed as $$f(u)=(24/u^4)(u^2/2+u/\sinh u-u/\tanh u). \tag{3}$$

The variable u in the above equations can only be found after solving the following:

$$E^2h^8/(1-\nu^2)^2P^2L^8=-81/16u^7\tanh u-27/16u^6\sinh^2 u+27/4u^8+9/8u^6 \tag{4}$$

For a wide range of pressure differences of interest it is found that u<<1 so that f(u) can be approximated as $f(u)=12/u^2$ and $u^2=8(W/h)^2$. Consequently, the relation between pressure and membrane geometry based on equation (1) and equation (2) simplifies to the form:

$$L=\{[64E/3(1-\nu^2)P]HW^3\}^{\frac{1}{4}} \tag{5}$$

which gives us a simple approach in the design realization. The maximum strain for the switch membranes is given by $\sigma_{max}/E$. Maximum stress ($\sigma_{max}$) can be determined using equations which are well known, but has been simplified for the worst case to:

$$\sigma_{max}=[Eu^23(1-\nu^2)](h/L)^2+(P/2)(L/h)^2. \tag{6}$$

Referring again to FIG. 1 and FIG. 2, the value of W for a particular pressure switch 10 is set by the thickness of the thermal oxide layer separating the upper and lower wafers and forming isolation pad 16. The thickness can be tightly controlled in a range from a few tens of nanometers to a few micrometers. Parameter h is the thickness of membrane 12 which can readily be controlled in the range of a few tens of micrometers to an accuracy of a few micrometers. Using these relationships, designs covering a range from a fraction of an atmosphere to several atmospheres of pressure difference can readily be realized. The switch point of pressure switch 10 (or any of the pressure switches in an array) is established by varying the thickness h of membrane 12, or the depth W of the well 24, or by adjusting the width L of membrane 12. Preferably, the thickness of membrane 12 and depth of well 24 are fixed within any particular batch of switches or arrays of switches, and the width L of membrane 12 is used as the variable to adjust pressure switch points. Suitable values of these parameters are selected to allow a range of membrane sizes which can be accurately controlled with the current silicon mask technology. However, to avoid fracture of the membranes due to exceeding the yield strength of silicon, it is preferable that $W/h << 1$.

An example of a specific design for pressure differences of ¼, ½, ¾ and 1 atm as the switch points follows. By replacing $E=1.9\times10^{12}$ dyn cm$^{-2}$, $v=0.09$, and evaluating parameter $u=0.01$ by selecting h to be 55 μm, then W=195 nm. The design parameters L, for the four pressure levels are tabulated in Table 2:

TABLE 2

| $P = P_i - P_r$ (atm) | L(μm) | $\sigma_{max}$ (dyn cm$^{-2}$) | Max. strain (worst case) |
|---|---|---|---|
| 0.25 | 90.2 | $2.4 \times 10^{+7}$ | $1.3 \times 10^{-5}$ |
| 0.50 | 75.8 | $3.4 \times 10^{+7}$ | $2.0 \times 10^{-5}$ |
| 0.75 | 68.5 | $4.2 \times 10^{+7}$ | $2.2 \times 10^{-5}$ |
| 1.00 | 63.8 | $4.8 \times 10^{+7}$ | $2.6 \times 10^{-5}$ |

The maximum stress of the membranes is found to be in the order of $10^7$ dyn cm$^{-2}$ which is very small compared with the yield strength of a silicon crystal in tensile stress of about $6.9\times10^{10}$ dyn cm$^{-2}$. The length of the membrane, K, is 2 mm for all switch points.

Figure 7:
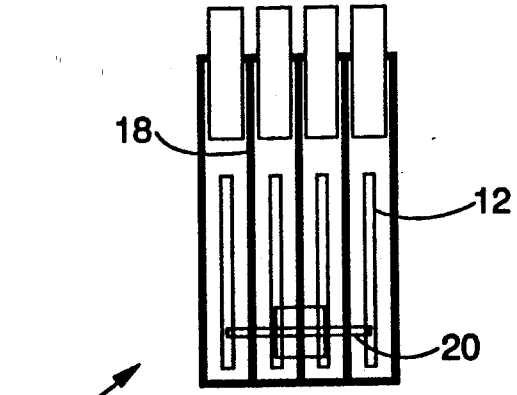
FIG. 7 is a top plan view of a second embodiment of a mask layout for fabrication of the present invention showing one vent back-side opening for all of the switch elements.
Figure 6:
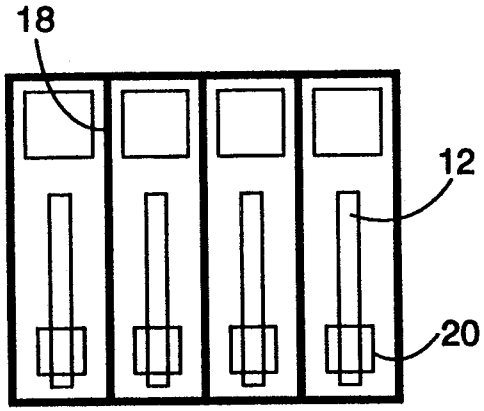
FIG. 6 is a top plan view of one embodiment of a mask layout for fabrication of an array of pressure switches of the present invention with separate vents for each switch element.

Referring now to FIG. 6, a schematic layout of a mask 44 for an array of pressure switches fabricated with a four mask process is shown where the vent 20 is designed for each element in the array separately. A schematic layout for an alternative embodiment of a mask with one vent back side opening for all elements is possible with an additional processes for the front side vent path as is shown in FIG. 7. In this case, back-sided alignment is required but array size reduction may be realized.

It should be noted that, while the pressure switch herein has been presented in a rectangular shape, the size and shape of the switch is not a limiting factor. So long as the design parameters are met for membrane 12 contacting electrode 54 at a specified pressure, oval, oblong, square, circular or other shapes could be used depending upon the particular application. Nor is size of the pressure switch a limiting factor Referring now to FIG. 8, a schematic cross-sectional view of the process steps for the fabrication of a four element pressure switch array can be seen. This cross-sectional representation generally corresponds to the cross-sectional view in FIG. 2, except that FIG. 2 shows only one pressure switch and the representation of FIG. 8 cuts through the region of pressure switch 10 which includes vent 20. Note also that, in general terms, the same process applies to a single element pressure switch or any number of pressure switches in an array.

At step 100, LPCVD $Si_3N_4$ layers 48 of thickness 90 nm are deposited on both surfaces of upper silicon wafer (substrate) 46 and a lower silicon wafer (substrate) 14. Etch windows are photolitographically defined. Upper wafer 46 is patterned for a plurality of isolator/polish stop regions 50 on its lower surface and lower wafer 14 is patterned for a plurality of vent regions 52 on its lower surface. The unmasked silicon nitride is then removed in a reactive ion etcher (RIE) with $CF_4$ plus 2% $O_2$ as an etching gas.

At step 110, a plurality of isolation grooves 18 and a plurality of vents 20 are formed by etching the wafers in a 23% concentration $KOH:H_2O$ solution at a temperature of 60° C. Typically isolation grooves 18 of depth 55 μm are etched into the lower surface of upper wafer 46, and vents 20 of depth of approximately 100 μm$^2$ are etched through lower wafer 14. The masking layer of $Si_3N_4$ is stripped using concentrated hydrofluoric acid. While vents 20 are shown in cross-section as being synclinically-shaped, they can be of other configurations.

At step 120, an $SiO_2$ thermal oxide layer 56 of thickness 195 nm is grown on both surfaces of upper wafer 46 in a dry oxidation at 1100° C. for about 2 hours. The thermal oxide layer on the lower surface of upper wafer 46 is then patterned for different values of membrane width, L1, L2, L3 and L4 for a four element pressure switch array as shown, and selectively removed to form a plurality of respective rectangular pressure wells 24. In the example shown, L4<L3<L2<L1. The patterned oxide layer on the lower surface of upper wafer 46 also forms a plurality of isolation pads 16 to insulate upper wafer 46 from lower wafer 14 and separate adjacent pressure wells 24.

At step 130, the wafers are cleaned in base and acid baths and are then dipped for a second time in buffered oxide etch (BOE). The surfaces are hydrated by a second dipping in a hot hydroxide solution, rinsed in deionized water and then are ready for aligned bonding. Surface features of the wafers are then aligned using an infrared aligner so that pressure wells 24 and isolation pads 16 are aligned in relation to vents 20 and electrode 54 as shown (see also FIG. 1). Alignment is preferably facilitated with alignment marks etched into lower wafer 14 and upper wafer 46, but other surface features could be used. Isolation pads 16 are then brought into contact with electrode 54 at room temperature where atomic bonds are formed without the use of adhesives. These bonds are of sufficient strength to maintain alignment while the wafers are transported to an annealing furnace. A high-temperature anneal at 900° C. in a forming gas of 4% $H_2$+Ar for 1 hour is used to subsequently chemically fuse the two wafers together.

At step 140, upper wafer 46 is thinned by grinding and polishing its upper surface to the level of isolation pads 16 (which is essentially coterminous with the level of isolation grooves 18) which also serve as polish stops. This forms separate isolated membranes 12 between isolation pads 16. A final slight etch with a chemical polish of $HNO_3HF:CH_3COOH$ (40:1:1) results in a smooth, shiny, clean isolated membrane surface. A one-second BOE dip is used to remove the native oxide as well as cleaning the opposing (inner) surfaces of upper silicon membranes 12 and electrode 54.

At step 150, a metal contact 56 is bonded to each of the isolated membranes 12 as well as to electrode 54 to complete the fabrication of the array.

As previously discussed, electrode 54 generally comprises lower wafer 14. While FIG. 8 appears to give the appearance of a plurality of isolated electrodes 54, lower wafer 14 actually serves as a single electrode 54 common to all pressure switches in the array. When FIG. 8 is viewed with reference to FIG. 1, it will be seen that the appearance of vents 20 separating lower wafer 14 into a plurality of electrodes 54 results from the cross-sectional representation of FIG. 8 being taken through a line cutting vents 20. It will be appreciated, however, that electrode 54 could alternatively be formed as a plurality of isolated regions formed on lower wafer 14 which are commonly interconnected.

Typical base materials used in the process are two 4–5 n cm resistivity 3" n-type silicon wafers with (100) surface orientation. Double sided polished wafers are used to reduce the optical distortion caused by normal surface roughness on the back side of the standard wafers when the wafers are aligned with an infrared aligner prior to bonding.

It will be appreciated that accuracy of the pressure switches can be improved by using precise wafer thinning techniques to form the membranes. In addition, the array size can be increased to include more elements to improve the sensitivity of the pressure range under test. The pressure switch disclosed herein is well suited to batch fabrication and could include an aligned and bonded electronics array interfacing with external drive circuits.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A solid state pressure switch, comprising:

(a) a resilient membrane formed on a first substrate;

(b) an electrode formed on a second substrate;

(c) an isolation pad, said isolation pad bonded to said membrane and said first substrate, said isolation pad electrically isolating said membrane from said first substrate, said isolation pad separating said membrane from said electrode;

(d) a well region disposed between said membrane and said electrode; and (e) a vent extending through said second substrate and into said well region.

2. The device recited in claim 1, wherein said first and second substrates consist of silicon, said membrane consists of silicon, and said isolation pad consists of silicon dioxide.

3. The device recited in claim 1, further comprising a plurality of metal contacts, at least one of said metal contacts bonded to said membrane, at least one of said metal contacts bonded to said electrode.

4. A pressure switch, comprising:

(a) a resilient silicon membrane formed on a first substrate;

(b) a silicon dioxide insulator, said insulator bonded to said silicon membrane and said first substrate, said insulator electrically isolating said membrane from said first substrate;

(c) a silicon electrode formed on a second substrate, said electrode bonded to said insulator, said insulator separating said membrane from said electrode;

(d) a pressure well disposed between said membrane and said electrode; and (e) a vent extending from said pressure well through said second substrate.

5. A pressure switch as recited in claim 4, wherein said pressure well comprises the area of separation between said membrane and said electrode, whereby said membrane deflects into said pressure well and electrically contacts said electrode upon application of pressure in a defined amount.

6. A pressure switch as recited in claim 5, further comprising a plurality of metal contacts, at least one of said metal contacts bonded to said membrane, at least one of said metal contacts bonded to said electrode.

7. A solid state pressure sensor array, comprising:

(a) a first silicon substrate having an electrode region;

(b) a second silicon substrate having a region separated into a plurality of isolated membranes by a plurality of isolation pads, said isolation pads bonded to and extending from said second silicon substrate, said isolation pads bonded to said first silicon substrate, said isolation pads separating said membranes from said electrode region;

(c) a plurality of membrane contacts, one of each said membrane contacts bonded to a respective one of said plurality of membranes; and (d) at least one electrode contact bonded to said electrode region.

8. The apparatus recited in claim 7, further comprising a plurality of pressure wells, said pressure wells disposed between said membranes and said electrode region whereby each said membrane deflects into a respective one of said pressure well and electrically contacts said electrode upon application of pressure in a defined amount.

9. The apparatus recited in claim 8, further comprising a plurality of vent, said vents extending from said pressure wells through said first silicon substrate.

10. A method of fabricating a solid state pressure switch, comprising the steps of:

(a) forming a resilient membrane on a first substrate, said first substrate having first and second surfaces, said membrane coplanar with said first substrate, said membrane electrically isolated from said first substrate by an isolation pad extending from said first surface of said first substrate, said isolation pad forming a well region;

(b) etching a vent between the surfaces of a second substrate having first and second surfaces; and (c) bonding said isolation pad to said second substrate, said vent extending into said well region.

11. The method recited in claim 10, further comprising the steps of:

(d) etching an isolation groove of a predetermined depth into said first surface of said first substrate;

(e) depositing a thermal oxide layer onto said first surface of said first substrate, said thermal oxide layer extending into said isolation groove; and (f) patterning and selectively removing said thermal oxide layer to form said isolation pad and said pressure well.

12. The method recited in claim 11, further comprising the step of thinning said second surface of said first substrate to said isolation groove.

13. The method recited in claim 10, wherein the step of bonding said isolation pad to said second substrate includes the steps of:

(d) aligning said isolation pad in relation to said vent;

(e) bringing said isolation pad and said second substrate into physical contact at room temperature where atomic bonds are formed without adhesives; and (f) annealing said bonded substrates.

14. A method of fabricating an integrated digital pressure switch array, comprising the steps of:

(a) etching a plurality of isolation grooves into the first surface of a first substrate having first and second surfaces, said isolation grooves defining polish stops;

(b) etching a plurality of vents in a second substrate having first and second surfaces, said vents extending between said first and second surfaces of said second substrate;

(c) depositing an epitaxial layer of thermal oxide on said first surface of said first substrate, said thermal oxide layer extending into said isolation grooves;

(d) patterning and selectively removing said thermal oxide layer adjacent to said isolation grooves to form a plurality of pressure wells of varying widths between a plurality of isolation pads extending from said first surface of said first substrate;

(e) grinding said second surface of said first substrate to said polish stops to form isolated membranes between said isolation pads;

(f) aligning said isolation pads in relation to said vents;

(g) bringing said isolation pads into physical contact with said second substrate whereby an atomic bond is formed; and (h) annealing said substrates to strengthen said atomic bond.

15. The method recited in claim 14, further comprising the steps of:

(i) depositing a layer of silicon nitride on said first surface of said first substrate;

(j) depositing a layer of silicon nitride onto said first surface of said second substrate;

(k) patterning said first surface of said first substrate for a plurality of isolation grooves and polish stops; and (l) patterning said first surface of said second substrate for a plurality of vents.

16. The method recited in claim 15, further comprising the steps of bonding a separate electrical contact to each of said isolated membranes, and bonding at least one electrical contact to said second substrate.

17. A solid state pressure switch fabrication process, comprising the steps of:

(a) etching an isolation groove into the first surface of a first silicon wafer having first and second surfaces;

(b) depositing an epitaxial layer of silicon dioxide on said first surface of said first wafer, said silicon dioxide layer extending into said isolation groove;

(c) etching a vent between the surfaces of a second silicon wafer;

(d) patterning and selectively removing said silicon dioxide layer to form a pressure well and isolation pad extending from said first surface of said first silicon wafer;

(e) thinning said second surface of said first wafer to said isolation groove to form a resilient membrane; and (f) bonding said isolation pad to said second wafer, said vent extending into said pressure well.

18. The process of claim 17, further comprising the steps (g) aligning said first and second silicon wafers;

(h) bringing said isolation pad into physical contact with said second silicon wafer until an atomic bond is formed; and (i) annealing said wafers to strengthen said atomic bond.

* * * * *